US007735977B2

(12) United States Patent
Murata

(10) Patent No.: US 7,735,977 B2
(45) Date of Patent: Jun. 15, 2010

(54) DROPLET DISCHARGING HEAD AND INKJET RECORDING APPARATUS

(75) Inventor: Michiaki Murata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 443 days.

(21) Appl. No.: 11/900,554

(22) Filed: Sep. 12, 2007

(65) Prior Publication Data

US 2008/0180490 A1 Jul. 31, 2008

(30) Foreign Application Priority Data

Jan. 25, 2007 (JP) ..... 2007-015660

(51) Int. Cl.
*B41J 2/045* (2006.01)
*B41J 2/05* (2006.01)

(52) U.S. Cl. ..... 347/70; 347/58

(58) Field of Classification Search ..... 347/70, 347/68–69, 71–72, 58, 50; 400/124.14–124.16; 310/363, 366

See application file for complete search history.

(56) References Cited

U.S. PATENT DOCUMENTS

2008/0100676 A1* 5/2008 Sakaida ..... 347/70
2008/0218556 A1* 9/2008 Seto et al. ..... 347/50

FOREIGN PATENT DOCUMENTS

| | | |
|---|---|---|
| JP | 10-193595 | 7/1998 |
| JP | 2002-234158 | 8/2002 |
| JP | 2006-6096 | 1/2006 |

* cited by examiner

*Primary Examiner*—K. Feggins
(74) *Attorney, Agent, or Firm*—Fildes & Outland, P.C.

(57) ABSTRACT

A droplet discharging head comprising: a piezoelectric element that has a flex-deformable piezoelectric body, a first electrode, and a second electrode that sandwich the piezoelectric body therebetween; a vibrating plate arranged at the first electrode side of the piezoelectric element; a wiring plate that is arranged at the second electrode side of the piezoelectric element and is provided with a first electrical wiring that supplies an electrical signal to the piezoelectric element; a pressure chamber provided at a side opposite the piezoelectric element with the vibrating plate disposed therebetween; and a discharge port that discharges droplets from the pressure chamber, the first electrode and the first electrical wiring being individually connected via a through-hole formed in the second electrode, is provided.

16 Claims, 13 Drawing Sheets

DROPLET DISCHARGING HEAD AND INKJET RECORDING APPARATUS

CROSS-REFERENCE TO RELATED APPLICATION

This application claims priority under 35 USC 119 from Japanese Patent Application No. 2007-015660 filed on Jan. 25, 2007.

BACKGROUND

1. Technical Field

The present invention relates to a droplet discharging head and an inkjet recording apparatus.

2. Related Art

Conventional inkjet recording apparatuses (or image forming apparatuses) include those that use droplet discharging heads; for example, an apparatus with an inkjet recording head having multiple nozzles, from which ink droplets are selectively discharged, whereby images (including characters and the like) are recorded onto a recording medium such as recording paper. The inkjet recording heads of this type of inkjet recording apparatus causes a vibrating plate that comprises a pressure chamber to displace, whereby ink filled inside the pressure chamber is made to discharge from the nozzles. A piezoelectric element is formed on the vibrating plate in order to make the vibrating plate displace.

SUMMARY

According to an aspect of the invention, there is provided: a droplet discharging head comprising: a piezoelectric element that has a flex-deformable piezoelectric body, a first electrode, and a second electrode that sandwich the piezoelectric body therebetween; a vibrating plate arranged at the first electrode side of the piezoelectric element; a wiring plate that is arranged at the second electrode side of the piezoelectric element and is provided with a first electrical wiring that supplies an electrical signal to the piezoelectric element; a pressure chamber provided at a side opposite the piezoelectric element with the vibrating plate disposed therebetween; and a discharge port that discharges droplets from the pressure chamber, the first electrode and the first electrical wiring being individually connected via a through-hole formed in the second electrode.

BRIEF DESCRIPTION OF THE DRAWINGS

Exemplary embodiments of the present invention will be described in detail based on the following figures, wherein.

DETAILED DESCRIPTION

Figure 1:
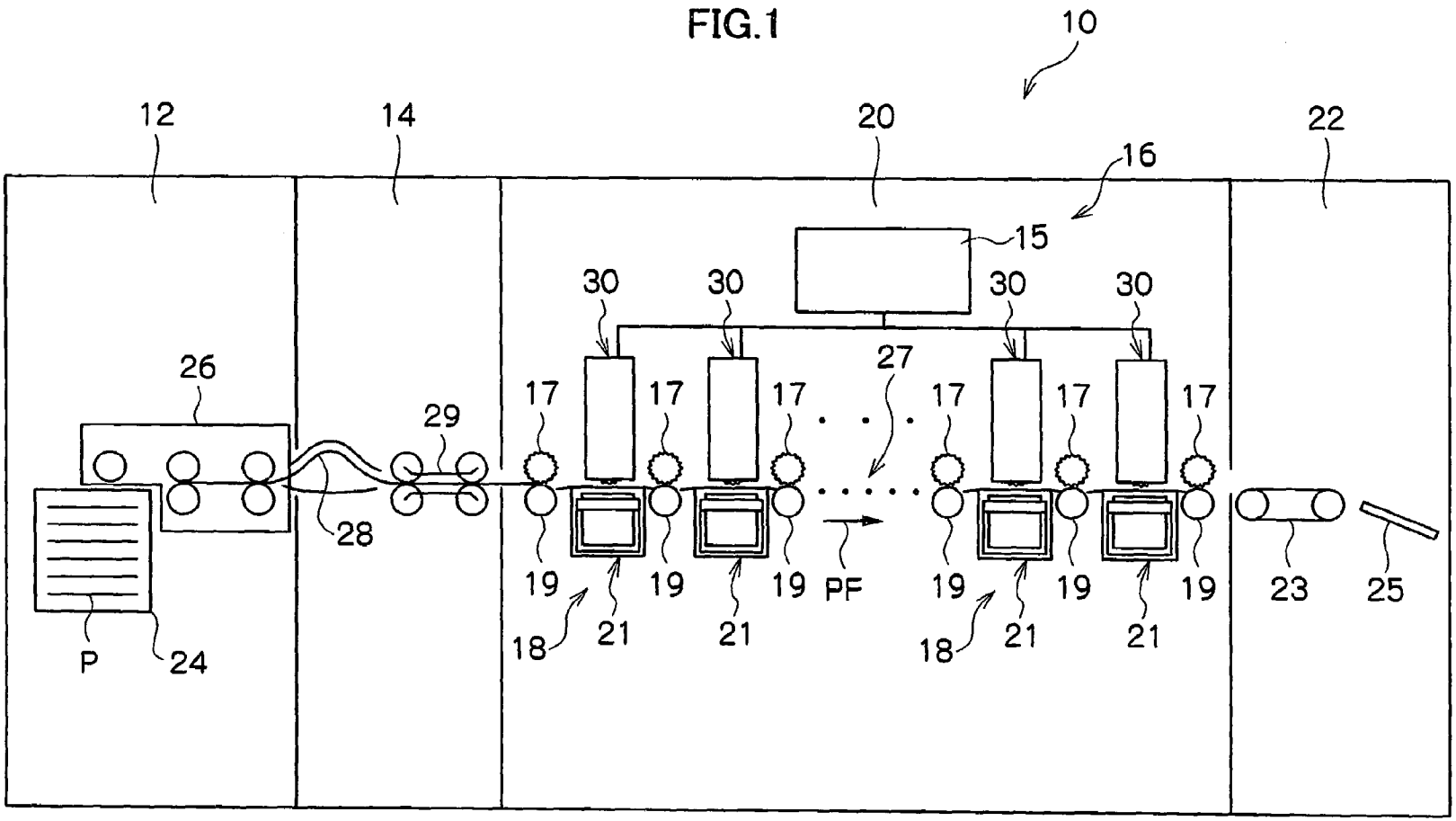
FIG. 1 is a schematic front view showing an inkjet recording apparatus relating to exemplary embodiments of the present invention.

Hereafter, the exemplary embodiments of the present invention will be explained in detail based on the examples shown in the drawings.

First, an inkjet recording apparatus 10 provided with droplet discharging heads will be explained as an example. Accordingly, the explanations will take the liquid to be an ink 110, the droplet discharging head to be an inkjet recording head 32, and the recording medium to be a recording paper P.

As shown in FIG. 1, the inkjet recording apparatus 10 basically comprises: a paper supplying portion 12 that sends out the recording paper P; an register adjustment portion 14 that controls the approach of the recording paper P; a recording portion 20 provided with a recording head portion 16 that discharges ink droplets and forms images on the recording paper P and a maintenance portion 18 that performs maintenance on the recording head portion 16; and a discharging portion 22 that discharges the recording paper P on which an image has been formed at the recording portion 20.

The paper supplying portion 12 is comprised of a stocker 24 in which the recording paper P is laminated and stocked, and a conveying device 26 that takes paper one sheet at a time from the stocker 24 and conveys it to the register adjustment portion 14. The register adjustment portion 14 has a loop-forming portion 28 and a guide member 29 that controls the approach of the recording paper P. By passing the recording paper P through this portion, a strainer is used to correct any skew, the timing of conveying is controlled, and the recording paper P is supplied to the recording portion 20. The discharging portion 22 then stores the recording paper P on which an image is formed at the recording portion 20 via a discharge belt 23 to a tray 25.

A paper-conveying path 27 that conveys the recording paper P is formed between the recording head portion 16 and the maintenance portion 18 (the direction in which the paper is conveyed is shown with the arrow PF). The paper-conveying path 27 has star wheels 17 and conveying rolls 19 and the recording paper P is held and conveyed successively (without stopping) between the star wheels 17 and conveying rolls 19. Ink droplets are then discharged from the recording head portion 16 onto the recording paper P and an image is formed on the recording paper P.

In this manner, the portion that conveys the recording paper P is formed from the conveying device 26, the star wheels 17, and the conveying rolls 19.

The maintenance portions 18 have maintenance devices 21 that are arranged opposite inkjet recording portions 30 and perform processes such as capping and wiping with respect to inkjet recording head 32, as well as preliminary discharge and suction. Here, each inkjet recording head 32 is connected to a control device (control portion) 15. With this control device 15, drive waveforms are outputted based on image data, and the driving of the inkjet recording heads 32 is controlled.

Figure 2:
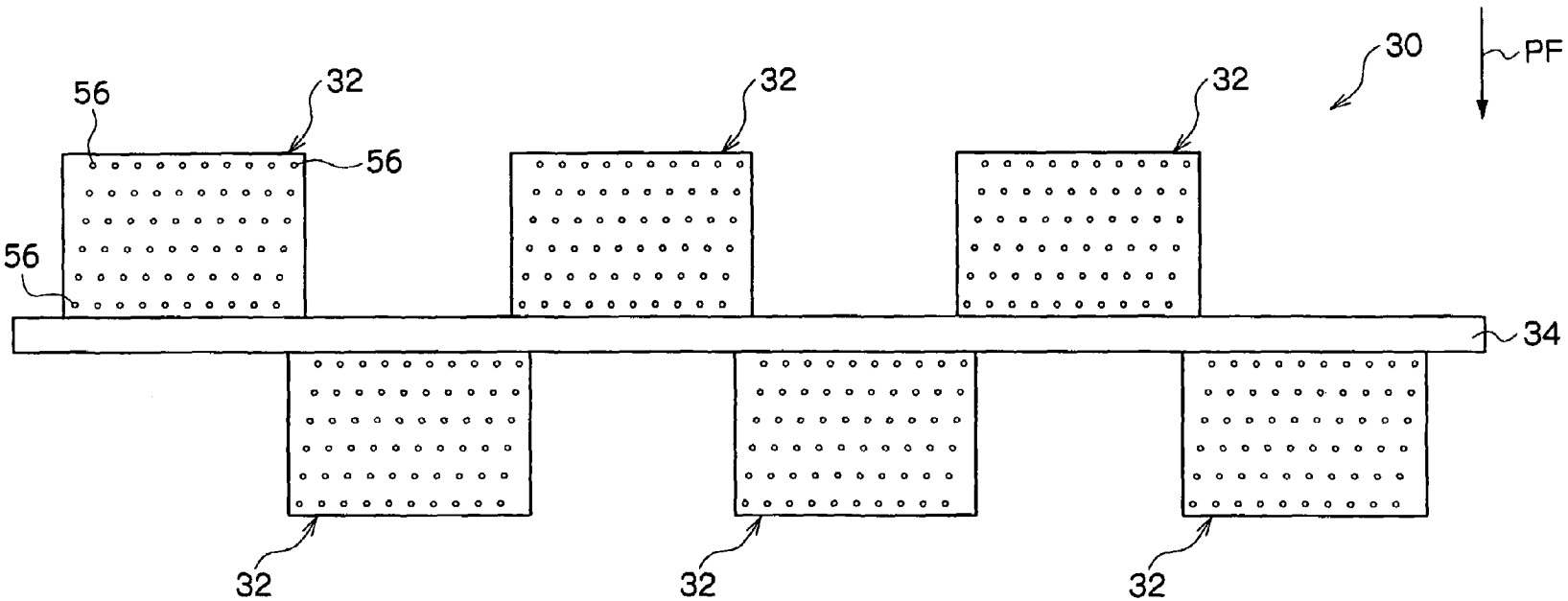
FIG. 2 is an explanatory drawing showing the arrangement of inkjet recording heads relating to the exemplary embodiments of the present invention.

As shown in FIG. 2, each inkjet recording portion 30 is provided with a support member 34 arranged in the direction perpendicular to the direction shown with the arrow PF, in which the recording paper P is conveyed. Plural inkjet recording heads 32 are attached to the support member 34. Plural nozzles 56 are formed in the inkjet recording heads 32 in a matrix form, and the nozzles 56 are arranged in parallel at a constant pitch across the entire inkjet recording portion 30 in the widthwise direction of the recording paper P. Ink droplets are discharged from the nozzles 56 with respect to the recording paper P conveyed continuously along the paper-conveying path 27, and an image is recorded on the recording paper P. In order to record what is known as full-color images, the inkjet recording portions 30 may have arranged therein, e.g., at least four colors corresponding to yellow (Y), magenta (M), cyan (C), and black (K).

Figure 3:
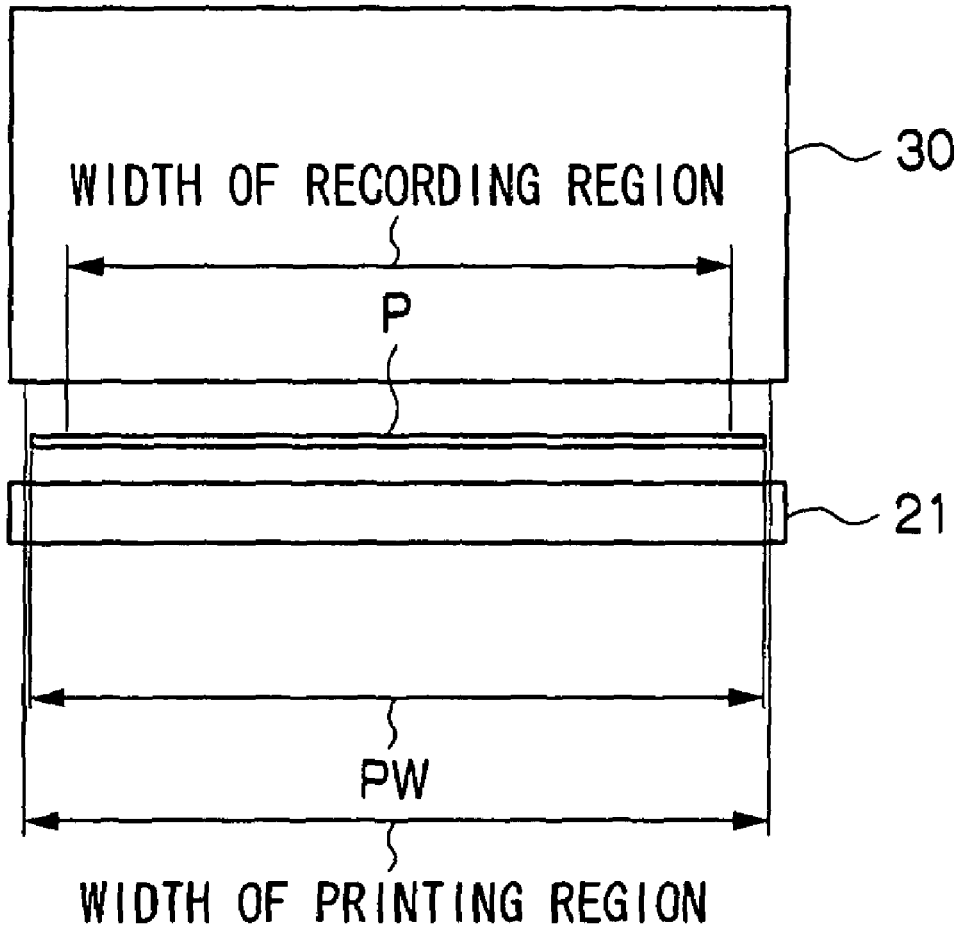
FIG. 3 is an explanatory drawing showing the relation between the width of a printing region of the inkjet recording heads relating to the exemplary embodiments of the present invention, and the width of a recording medium.

As shown in FIG. 3, the printing region width from the nozzles 56 of each inkjet recording portion 30 is made larger than the greatest paper width PW of the recording paper P, on which it is assumed that image recording with the inkjet recording apparatus 10 will be performed. Image recording is thus possible across the entire width of the recording paper P without moving the inkjet recording portion 30 in the widthwise direction of the paper. In other words, the inkjet recording portion 30 is made to be a full-width array (FWA), making single-pass printing possible.

Here, the printing region width is essentially the largest part of the recording region minus the margins from both sides of the recording paper P where no printing is performed. This is generally larger than the greatest paper width PW on which printing is performed. This is due to the fact that the recording paper P might be conveyed with a tilt at a given angle (i.e., skew) relative to the direction of conveyance, and because there is high demand for borderless printing.

Figure 4:
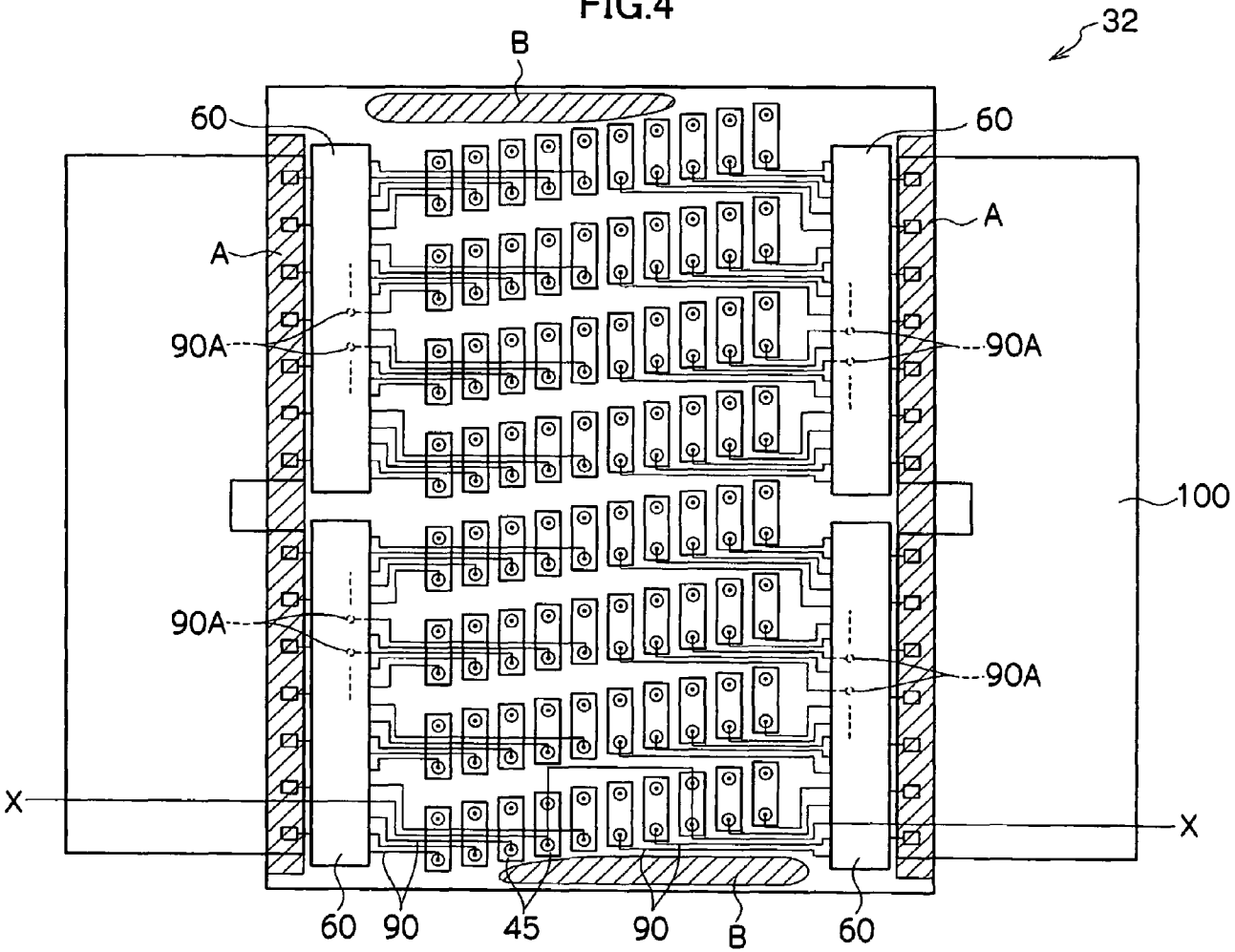
FIG. 4 is a schematic plan view of an inkjet recording head relating to the exemplary embodiments of the present invention.
Figure 5:
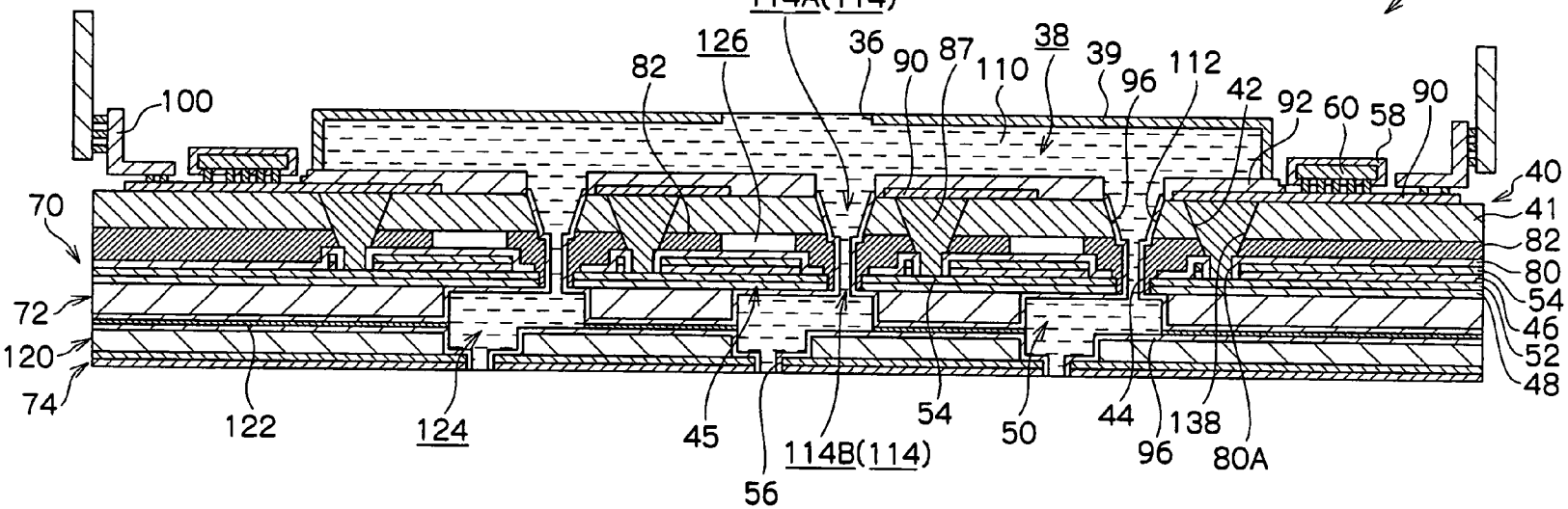
FIG. 5 is a cross-sectional view of the X-X line in FIG. 4.
Figure 7A:
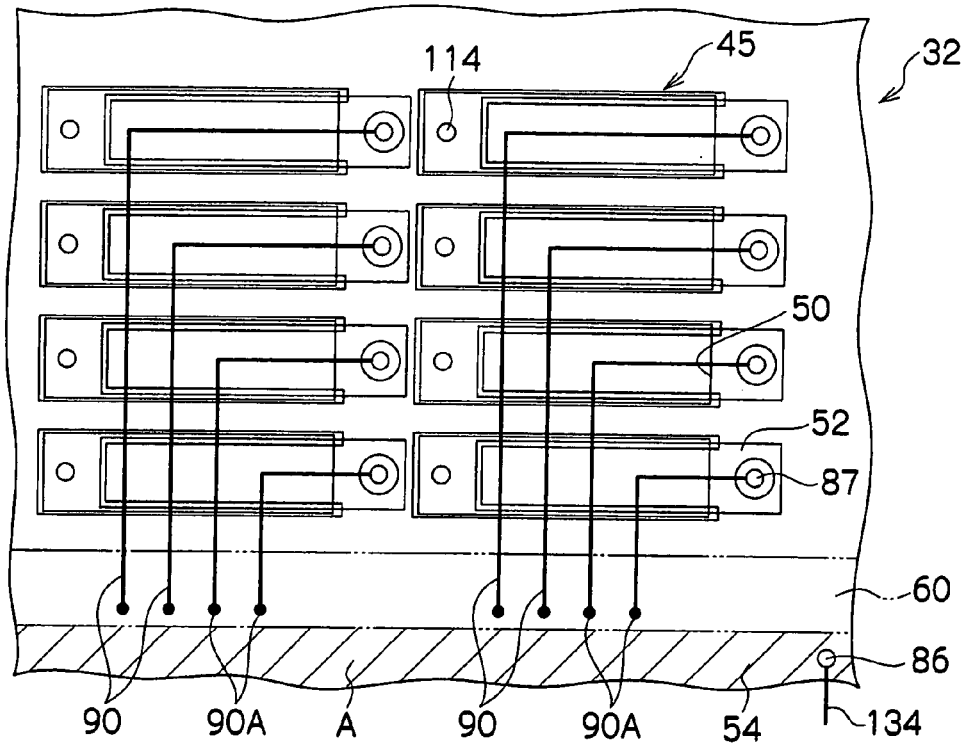
FIG. 7A is a schematic plan view of an inkjet recording head relating to a first exemplary embodiment of the present invention.
Figure 7B:
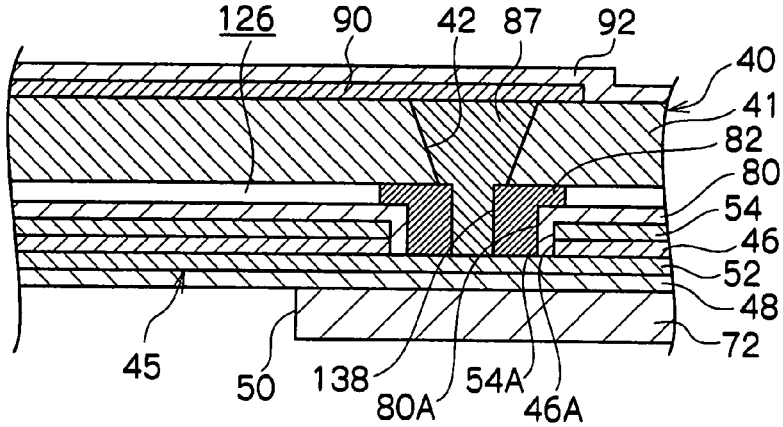
FIG. 7B shows a cross-sectional view of FIG. 7A.
Figure 7C:
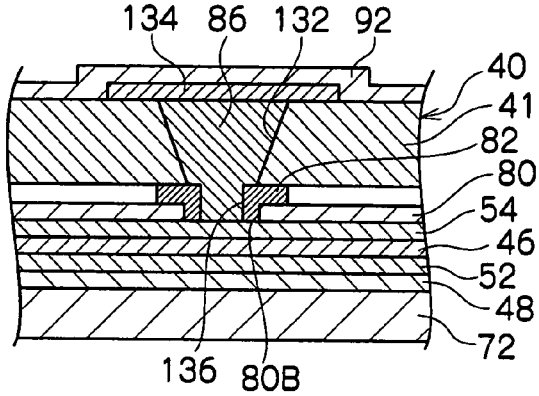
FIG. 7C shows a cross-sectional view of FIG. 7A.

Next, detailed explanations will be given with regard to the inkjet recording head 32 in the inkjet recording apparatus 10 configured as described above. FIG. 4 is a schematic plan view showing the entire configuration of an inkjet recording head 32, and FIG. 5 is a cross-sectional view of the X-X line in FIG. 4. Further, FIG. 7A shows a schematic enlarged drawing of FIG. 4, and FIGS. 7B and 7C show cross-sectional views of FIG. 7A.

First Exemplary Embodiment

As shown in FIGS. 4 and 5, a top plate member 40 is arranged in this inkjet recording head 32. In the present exemplary embodiment, a top plate (wiring plate) 41 made of glass that makes up the top plate member 40 is plate-shaped and has wiring, and is the top plate of the overall inkjet recording head 32.

A pool chamber member 39 formed from a material with ink-resistance is affixed to the top plate member 40, and an ink pool chamber 38 that has a predetermined shape and volume is formed between the pool chamber member 39 and the top plate 41. An ink supply port 36 linked to an ink tank (not shown) is provided in the pool chamber member 39 at a predetermined place. The ink 110 injected from the ink supply port 36 is stored in the ink pool chamber 38.

Figure 6:
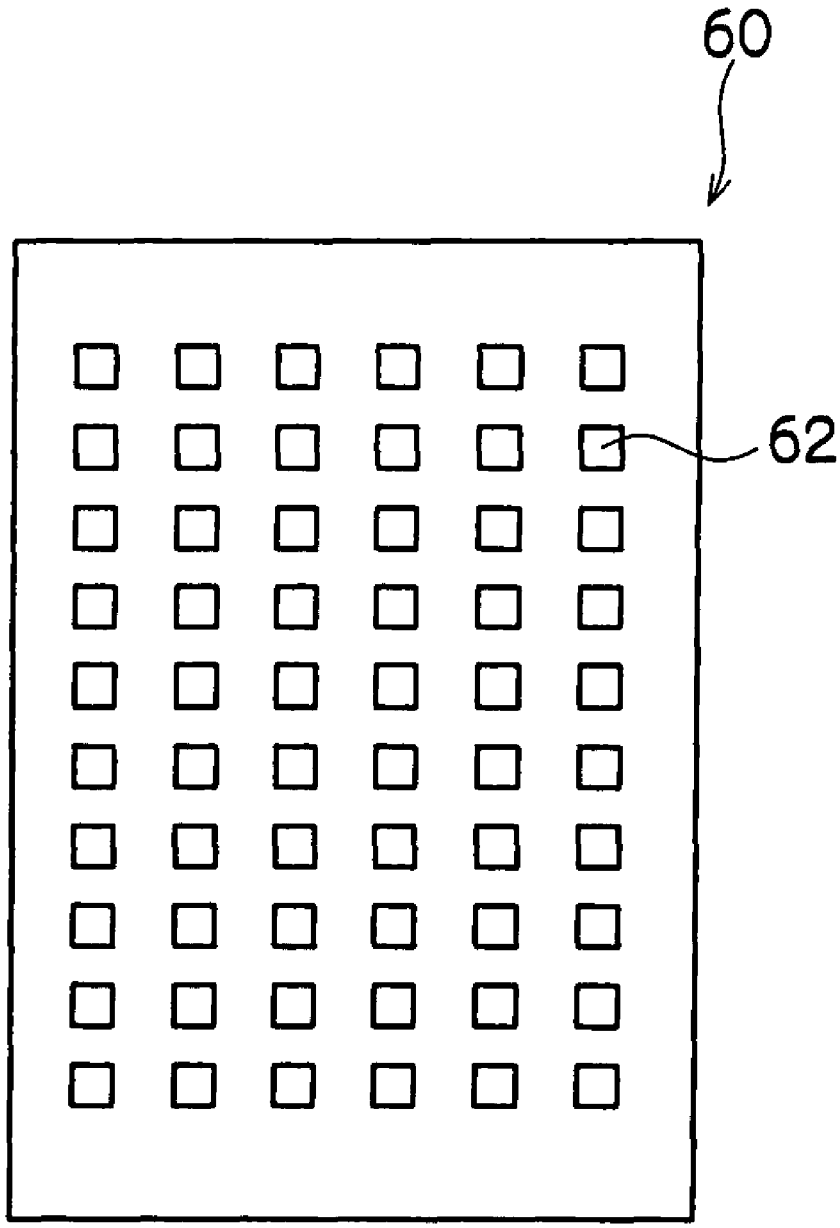
FIG. 6 is a schematic plan view showing bumps of a drive IC of the inkjet recording head relating to the exemplary embodiments of the present invention.

The top plate member 40 is also provided with drive ICs 60 (integrated circuits) and metal wiring 90 (a first electrical wiring) for supplying electrical signals from the drive IC 60. As shown in FIG. 6, plural bumps 62 are provided to protrude at predetermined heights in a matrix pattern from the bottom surface of the drive IC 60. The drive IC 60 is flip-chip mounted on the metal wiring 90 at the outer side of the pool chamber member 39 on the top plate 41 (i.e., the bumps 62 of the drive IC 60 are connected to terminals (connection portions) 90A of the metal wiring 90). The periphery of the drive IC 60 is sealed with resin material 58. Also, the metal wiring 90 is configured to be covered and protected by a resin protective film 92 so as to prevent corrosion due to the ink 110.

Also, pressure chambers 50, to be described later, and ink supply through-ports 112 that correspond one-to-one therewith are formed in the top plate 41, and the interior thereof makes up a first ink supply path 114A. Further, electrical connection through-ports 42 (to be described later) are formed in the top plate 41 at positions that correspond to the peripheral walls of the pressure chambers 50.

The pressure chambers 50 filled with the ink 110 supplied from the ink pool chamber 38 are formed in the silicon substrate 72, which acts as a flow path substrate. A connecting path substrate 120 formed from SUS is joined to the bottom portion of this silicon substrate 72 via adhesive 122.

A connecting path 124 connected to the pressure chambers 50 is formed in the connecting path substrate 120. The linking path 124 is made so as to be a space that is narrower than the pressure chambers 50. A nozzle plate 74 in which the nozzles 56 that connect to the connecting path 124 are formed is affixed to the bottom surface of the connecting path substrate 120.

Also, piezoelectric elements 45, to be described later, are formed in the surface of the silicon substrate 72 (made as a piezoelectric element substrate 70). The piezoelectric element substrate 70 has a vibrating plate 48 which forms one face of the pressure chambers 50. The vibrating plate 48 is an SiOx film formed with a chemical vapor deposition (CVD) method, and is configured to have elasticity in at least the up and down directions, and when voltage is applied to the piezoelectric elements 45, it flex-deforms (i.e., displaces) in the up and down directions. Note that there are no adverse effects even if the vibrating plate 48 is a metal material such as chromium (Cr). The volume of the pressure chamber 50 is made to increase and decrease due to the vibration of the vibrating plate 48 and pressure waves are generated, such that ink droplets are discharged from the nozzles 56 through the connecting path 124.

The piezoelectric elements 45 are provided on the upper surface of the vibrating plate 48 for each pressure chamber 50. The process of forming the piezoelectric elements 45 involves forming a laminated film of iridium(Ir) and titanium (Ti) by sputtering (a lower electrode (first electrode) 52) on the upper surface of the vibrating plate 48 formed on the silicon substrate 72, and on the upper surface of this laminated film, a PZT (lead zirconate titanate) film (a piezoelectric body 46) is formed by sputtering. Further, An Ir film (a upper electrode (second electrode) 54) is formed on the upper surface of this PZT film. Then the upper electrodes 54, the piezoelectric body 46, and the bottom electrode 52 are respectively sputtered and the piezoelectric elements 45 are formed.

The surfaces of this piezoelectric elements 45 are covered and protected with a low-permeability insulation film (hereafter, "SiOx film") 80. The SiOx film 80 is applied under conditions of decreased moisture permeability, to prevent moisture from entering the interior of the piezoelectric element 45 and degrading its reliability (i.e., it prevents deterioration of piezoelectric qualities due to oxygen reduction taking place in the PZT film).

Further, a partition resin layer 82 is laminated on the SiOx film 80 and partitions the space between the piezoelectric element substrate 70 and the top plate member 40. An ink supply through-port 44 that connects the ink supply through-port 112 of the top plate 41 and the pressure chamber 50 of the silicon substrate 72 is formed in the partition resin layer 82, and the interior thereof makes up a second ink supply path 114B.

This second ink supply path 114B has a cross-sectional area that is smaller than the cross-sectional area of the first ink supply path 114A, and is adjusted so that the flow path resistance at an overall ink supply path 114 becomes a predetermined value. That is, the cross-sectional area of the first ink supply path 114A is made sufficiently larger than the cross-sectional area of the second ink supply path 114B such that, when compared to the flow path resistance at the second ink supply path 114B, the flow path resistance at the first ink supply path 114A can be made to be at a level where it can be substantially disregarded. Accordingly, the flow path resistance of the ink supply path 114 from the ink pool chamber 38 to the pressure chamber 50 is regulated with the second ink supply path 114B.

The inner wall surfaces of the ink supply through-ports 112 and 44, the pressure chambers 50, and the connecting path 124, which are wall surfaces that are contacted by at least the ink 110, are then coated by an inner surface process film (SiCN film) 96 which is integrally formed by a plasma CVD method so as to include the joining portions of the wall surfaces (i.e. their border portions), thus improving ink resistance.

A space 126 (i.e., an air layer) is also provided at the upper portion of the pressure chamber 50 between the top plate member 40 and the piezoelectric element 45 (specifically, the SiOx film 80 on the piezoelectric element 45), to negate any adverse effects on the driving of the piezoelectric element 45 and the vibration of the vibrating plate 48.

Here, as shown in FIG. 7B, through-holes 54A, 46A are respectively formed at the upper electrode 54 and the piezoelectric body 46 that form the piezoelectric element 45 at the upper portion of the peripheral wall of the pressure chamber 50 (i.e., the silicon substrate 72). The surfaces of the through-holes 54A, 46A are covered with the SiOx film 80.

Then, a through-hole 80A, having a smaller diameter than the through-holes 54A and 46A, is formed at the SiOx film 80 of the inner side of the through-holes 54A and 46A. An electrical connection through-port 138, connected to the electrical connection through-port 42 and having a smaller diameter than the electrical connection through-port 42, is formed in the partition resin layer 82 formed inside the through-hole 80A.

A conductive material in paste form (hereafter, "conductive paste") 87 is then filled inside the electrical connection through-ports 42 and 138. The metal wiring 90 and the lower electrode 52 are thus electrically connected via the conductive paste 87.

That is, the lower electrode 52 is individuated and the metal wiring 90 is extended over the upper surface of the top plate 41 and connected to the drive IC 60 as individualized wiring. Note that a flexible printed circuit (FPC) 100 is also connected to the metal wiring 90 (see FIG. 4).

Figure 8A:
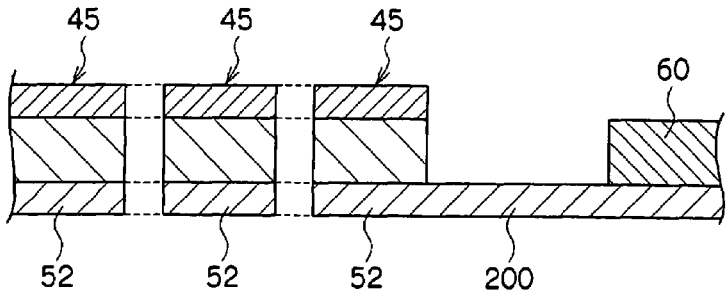
FIG. 8A is an explanatory drawing showing the connection between the drive IC and electrical wiring.
Figure 8B:
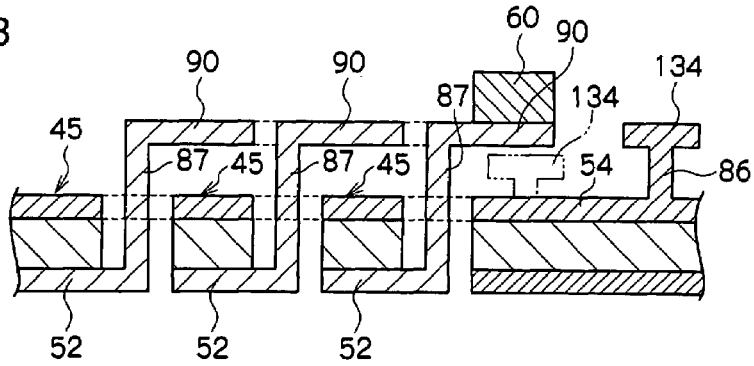
FIG. 8B is an explanatory drawing showing the connection between the drive IC and the electrical wiring.

As shown in FIGS. 8A and 8B, the upper electrode 54 of each piezoelectric element 45 is made into a common electrode. Then, as shown in FIGS. 7A and 7C, an electrical connection through-port 132 is formed in the top plate 41 further to the outer side thereof than the terminals 90A (hereafter, simply referred to as the "terminals 62 of the metal wiring 90") provided at the metal wiring 90 for supplying electrical signals from the drive IC 60 (i.e., between the terminals 90A of the metal wiring 90 and the outer edge portion of the top plate 41 at the side near these terminals 90A; that is, the A region shown in FIG. 4). A through-hole 80B is formed in the SiOx film 80 at a position that corresponds to the electrical connection through-port 132.

An electrical connection through-port 136 connected to the electrical connection through-port 132 is formed in the partition resin layer 82 formed in the through-hole 80B. The conductive paste 86 is then filled into the electrical connection through-ports 132 and 136, electrically connecting GND wiring (ground wiring) 134 and the upper electrode 54 via the conductive paste 86.

Next, the effects of the inkjet recording apparatus 10 provided with the inkjet recording heads 32 will be explained.

First, when an electrical signal giving the command to print is sent to the inkjet recording apparatus 10, a sheet of recording paper P is picked up from the stocker 24 and conveyed by the conveying device 26.

In the inkjet recording portions 30, the ink 110 has already been injected (i.e., filled) into the ink pool chamber 38 of the inkjet recording heads 32 from the ink tank via the ink supply port. The ink 110 filled in the ink pool chamber 38 is supplied (i.e., filled) to the pressure chamber 50 through the ink supply path 114. At this time, the surface of the ink 110 at the sides of the pressure chamber 50 forms into a slightly concave meniscus at the leading end of the nozzle 56 (i.e., at the discharge port).

Ink droplets are then selectively discharged from plural nozzles 56 while the recording paper P is conveyed, whereby a part of an image is recorded on the recording paper P based on the image data. In other words, voltage is applied to predetermined piezoelectric element 45 at a predetermined timing with the drive IC 60, the vibrating plate 48 is made to flex-deform in the up and down directions (i.e., out-of-plane vibration), and the ink 110 in the pressure chamber 50 is pressurized and discharged as ink droplets from predetermined nozzle 56.

In this manner, when the image has been completely recorded on the recording paper P based on the image data, the recording paper P is discharged to the tray 25 with the discharge belt 23, thus completing print processing (i.e., image recording) to the recording paper P.

Figure 11:
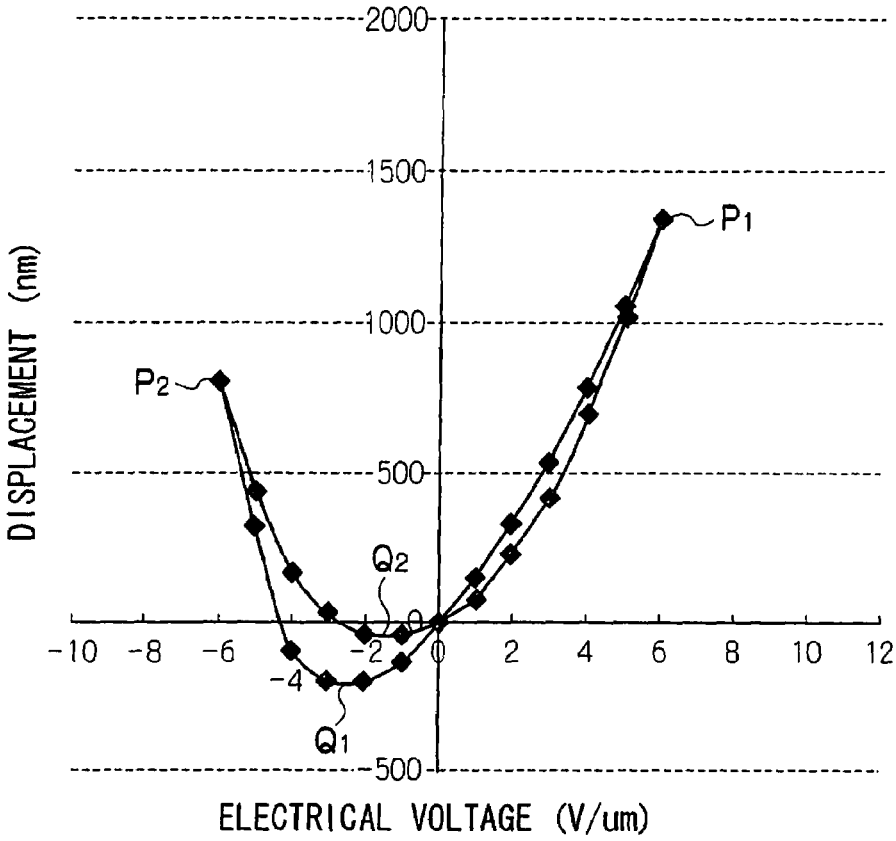
FIG. 11 is a graph showing the amount of displacement of piezoelectric bodies relative to the direction of polarization of the piezoelectric bodies that form piezoelectric elements of the inkjet recording head relating to the exemplary embodiments of the present invention.
Figure 12:
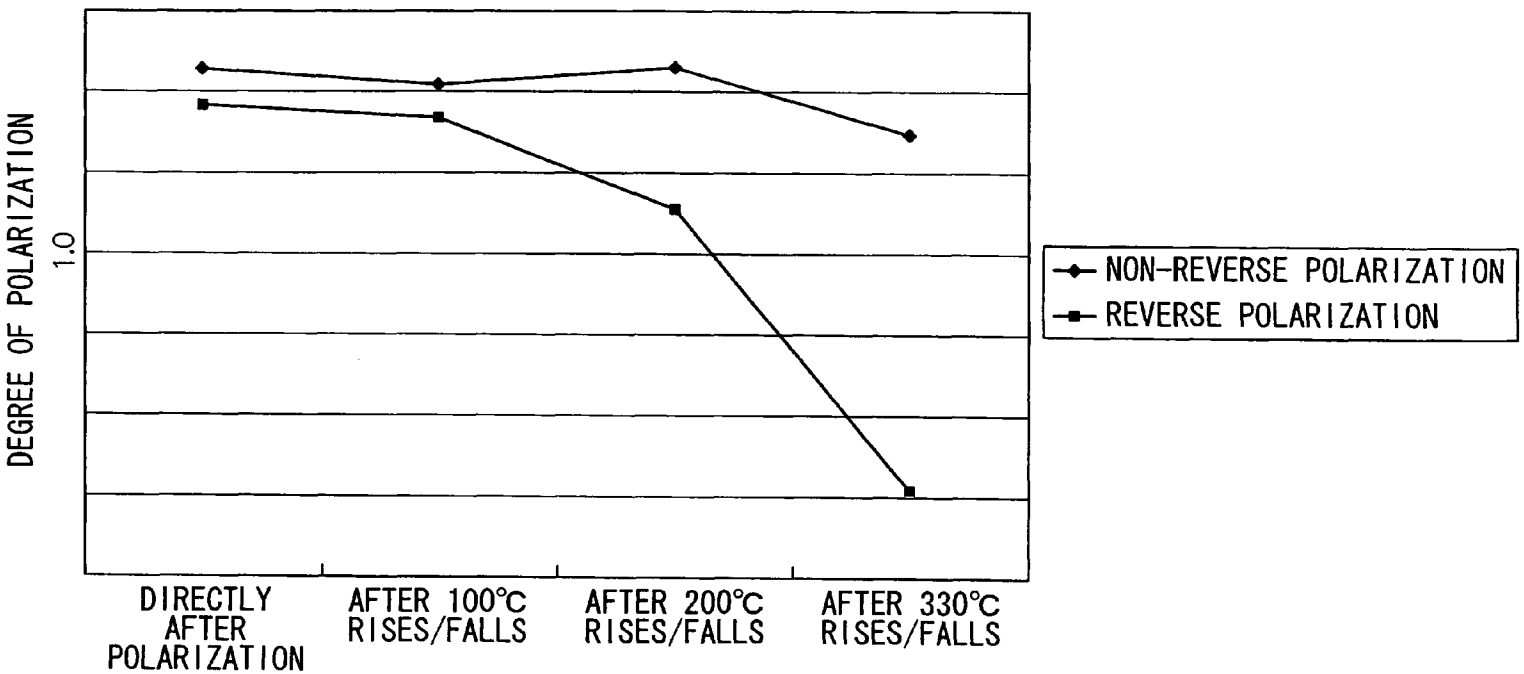
FIG. 12 is a graph showing the temperature stability of the degree of polarization depending on differences in the direction of polarization of the piezoelectric bodies.

Here, as shown in FIG. 11, when a PZT film is formed with a sputter method at the piezoelectric element 45, the voltage of the lower electrode 52 is made higher than the voltage of the upper electrode 54, whereby displacement increases. As shown in FIG. 12, it is observed that if the voltage at the lower electrode 52 side is made higher than the voltage of the upper electrode 54 and polarization processing is performed, the degree of polarization increases (as well as its corresponding displacement efficiency) and further, long-term stability increases. Here, reference to the degree of polarization indicates a level of polarization where the value prior to polarization is set to be 1.0.

For the above reasons, in the present exemplary embodiment, the electrical connection through-port 42 is formed in the top plate 41, the through-holes 54A, 46A are formed in the upper electrode 54 and the piezoelectric body 46, and the electrical connection through-port 138 that is connected to the electrical connection through-port 42 is formed in the partition resin layer 82 formed in the through-holes 54A, 46A, as shown in FIGS. 7A and 7B. The conductive paste 87 is then filled into the electrical connection through-ports 42 and 138, and the metal wiring 90 and the lower electrode 52 are electrically connected via the conductive paste 87.

Further, the upper electrode 54 of each piezoelectric element 45 is made into a common electrode and the electrical connection through-port 132 is formed further to the outer side than the terminals 90A of the metal wiring 90 in the top plate 41. The electrical connection through-port 136 that is connected to the electrical connection through-port 132 is formed in the partition resin layer 82 within the through-hole 80B formed in the SiOx film 80 at the position corresponding to the electrical connection through-port 132. The conductive paste 86 is filled into these electrical connection through-ports 132, 136, and the GND wiring 134 and the upper electrode 54 are electrically connected via the conductive paste 86. That is, the lower electrode 52 side is made so as to have positive electric potential.

Note that here, the apparatus is made such that the upper electrode 54 is connected to the GND wiring 134 and positive voltage is applied to the lower electrode 52, and it is preferable that the voltage of the lower electrode 52 is higher than the voltage of the upper electrode 54. Thus, for example, 5V may be applied to the upper electrode 54, and a voltage higher than 5V may be applied to the lower electrode 52.

When the signal from the drive IC 60 is conducted to the metal wiring 90 of the top plate member 40, it is conducted to the lower electrode 52 due to the conductive paste 87 filled in the interior of the electrical connection through-ports 42 and 138. Voltage is then applied to the piezoelectric element 45 at a predetermined timing and the vibrating plate 48 flex-deforms in the up and down directions, whereby the ink 110 filled in the pressure chamber 50 is pressurized and ink droplets discharge from the nozzles 56 (see FIG. 5).

Here, as shown in FIG. 8A, when an individual wiring 200 is extended out at the same layer as that of the lower electrodes 52 (i.e., on the same flat surface) and connected to the drive IC 60, it becomes necessary to extend out the individual wiring 200 at the regions or spaces between the piezoelectric elements 45, and with a high density matrix arrangement where there are a lot of wires, the areas of the elements increase.

However, in the present exemplary embodiment, as shown in FIGS. 7B and 8B, the electrical connection through-ports 42 and 138 are formed in the top plate 41 and the partition resin layer 82, the lower electrode 52 and the metal wiring 90 are made to electrically connect via the conductive paste 87 inside the electrical connection through-ports 42, 138, and the metal wiring 90 is extended across the upper surface of the top plate 41. Accordingly, when compared to a case where the electrical wiring extends across on the same flat surface as the lower electrodes 52, the extension region of the metal wiring 90 is wide, therefore preventing increases in the area of the piezoelectric elements due to wiring.

Also, as shown in FIGS. 7A and 7B, the upper electrode 54 and electrical connection through-port 132 are electrically connected through the conductive paste 86 further to the outer side than the terminals 90A of the metal wiring 90. Further, the area of the GND wiring 134 is made wide such that wiring resistance decreases according to the amount by which the area increases. Further, the region where the individual wiring (metal wiring 90) extends across becomes wider. Note that the electrical connection through-port 132 for the conductive paste 86 can be formed at the lower portion of the drive IC 60, and the upper electrode 54 and the GND wiring 134 (as shown with dotted lines) can be electrically connected.

Figure 8C:
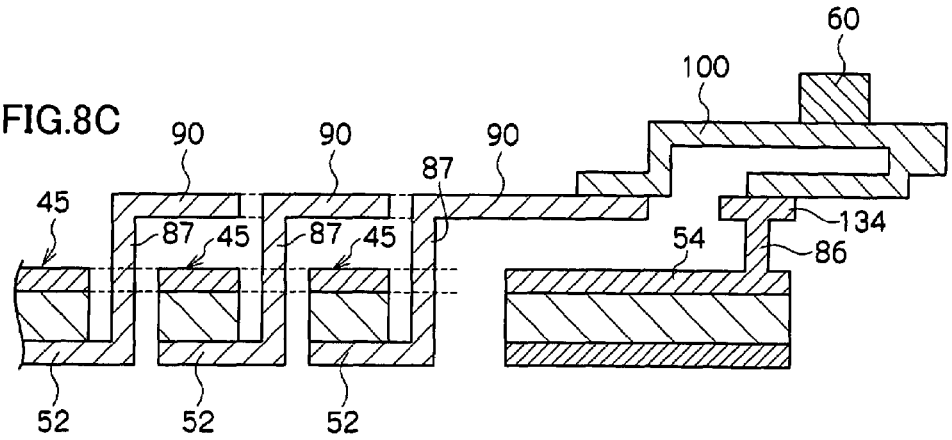
FIG. 8C is an explanatory drawing showing the connection between the drive IC and the electrical wiring.
Figure 13:
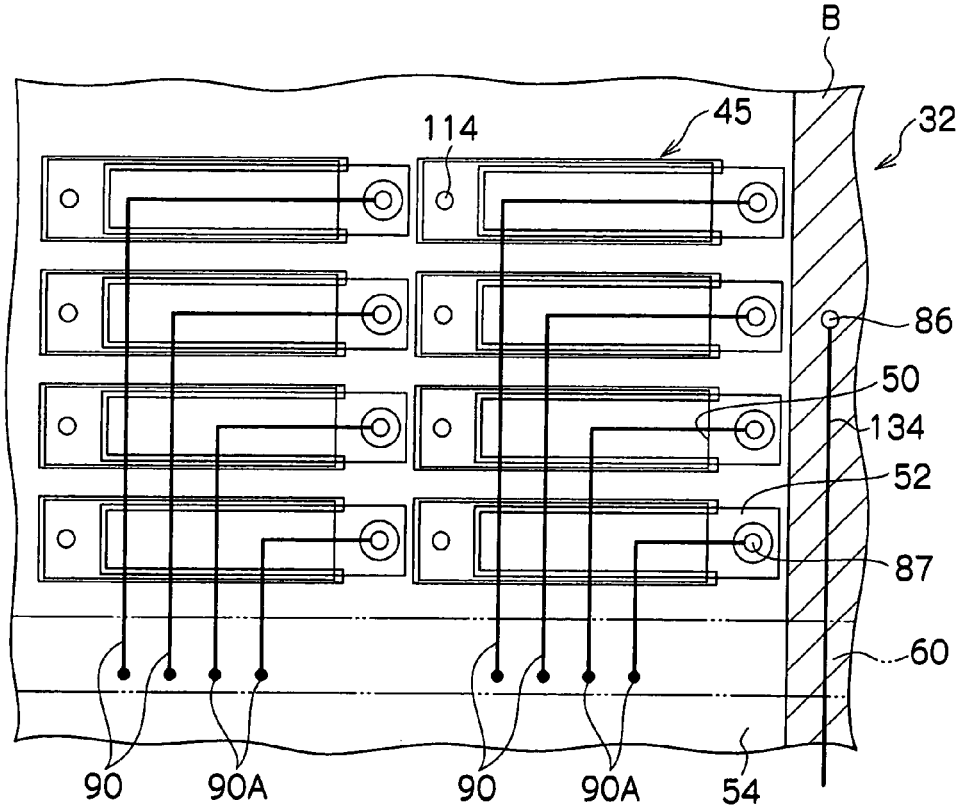
FIG. 13 is a schematic plan view of an inkjet recording head relating to an example of the first exemplary embodiment.

Here, the electrical connection of the upper electrode 54 and the GND wiring 134 is made between the terminals 90A of the metal wiring 90 and the outer edge portion of the top plate 41 at the side close to the terminals 90A (region A), as shown in FIGS. 4 and 7A. However, as shown in FIGS. 4 and 13, the connection can be made between the outer edge portion of the top plate 41 substantially perpendicular to the outer edge portion thereof at the side close to the terminals 90A of the metal wiring 90 and the formed region of the piezoelectric elements 45 (region B). Further, in FIG. 8B, the terminals 90A of the metal wiring 90 are connected to the drive IC 60; however, as shown in FIG. 8C, the connection with the drive IC 60 may be made via the flexible print substrate 100. In this case, the drive IC 60 is mounted on the flexible print substrate 100.

Second Exemplary Embodiment

Next, the inkjet recording head 32 of the second exemplary embodiment will be explained. Note that hereafter, configuration elements and members and the like that are the same as in the inkjet recording head 32 in the first exemplary embodiment have the same numbers, and detailed explanations thereof will be omitted (including the effects). Note that FIG. 9A shows a schematic plan view of the inkjet recording head 32 and FIG. 9B shows a cross-sectional view of FIG. 9A.

Figure 9A:
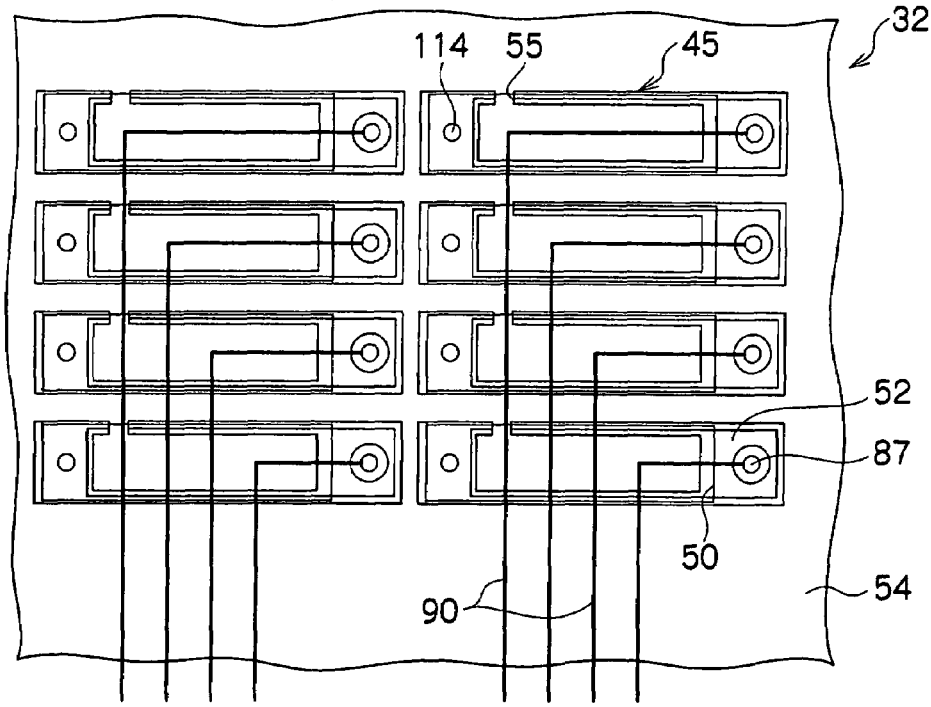
FIG. 9A shows a schematic plan view of an inkjet recording head relating to a second exemplary embodiment.
Figure 9B:
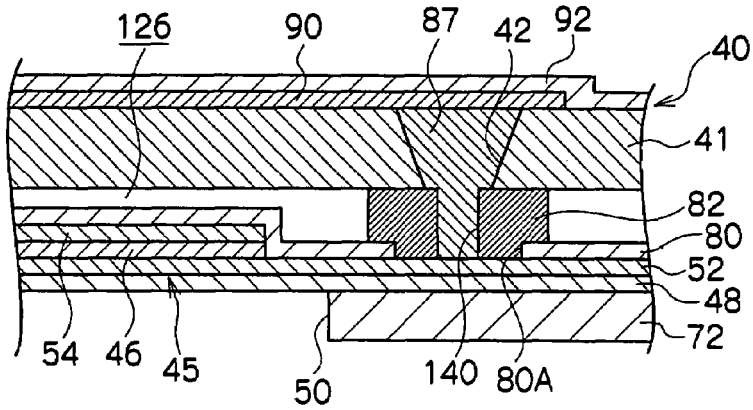
FIG. 9B shows a cross-sectional view of FIG. 9A.

As shown in FIGS. 9A and 9B, in the present exemplary embodiment, the upper electrode 54 and the piezoelectric body 46 are disposed at the inner side of the peripheral wall (the silicon substrate 72) of the pressure chamber 50, so the piezoelectric body 46 is less restricted by the peripheral wall of the pressure chamber 50. Here, the upper electrodes 54 are common electrodes so a connection wiring 55 is provided at portions of the upper electrodes 54 and the upper electrodes 54 are connected via the connection wiring 55.

The through-hole 80A is formed in the SiOx film 80 positioned at the upper portion of the peripheral wall of the pressure chamber 50 so as to avoid the upper electrode 54 and piezoelectric body 46. An electrical connection through-port 140 that is connected to the electrical connection through-port 42 is formed in the partition resin layer 82 inside this through-hole 80A.

The conductive paste 87 is filled into these electrical connection through-ports 42 and 140, and the metal wiring 90 and the lower electrode 52 are electrically connected via the conductive paste 87. That is, in the present exemplary embodiment, there are no layers of the piezoelectric body 46 and the upper electrode 54 in the periphery of the electrical connection through-port 140.

Third Exemplary Embodiment

Next, the inkjet recording head 32 of the third exemplary embodiment will be explained. Note that hereafter, configuration elements and members and the like that are the same as the inkjet recording head 32 in the first exemplary embodiment have the same numbers and detailed explanations thereof will be omitted (including the effects). Note that FIG.

Figure 10A:
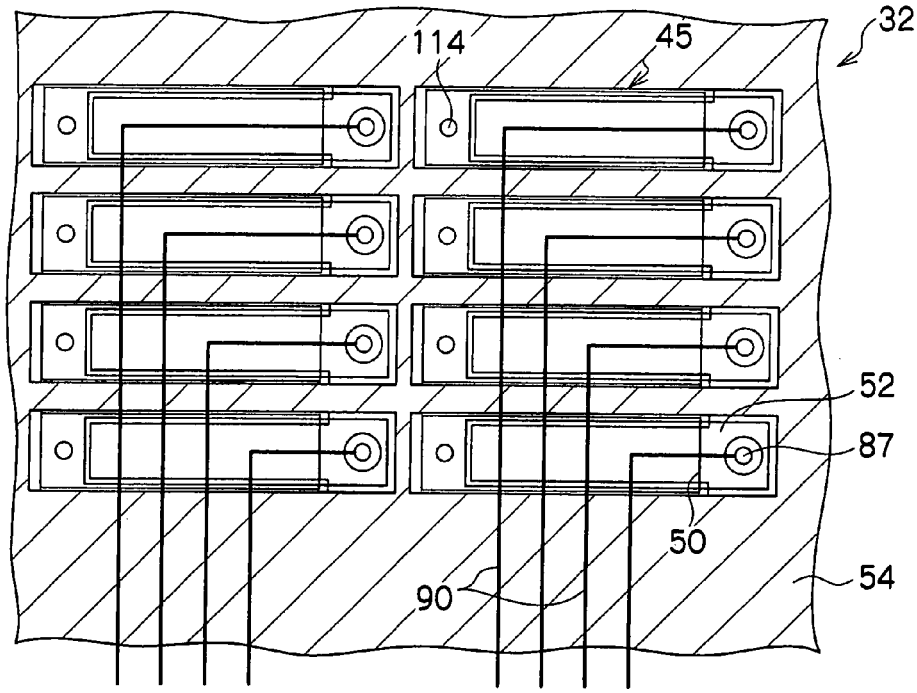
FIG. 10A shows a schematic plan view of an inkjet recording head relating to a third exemplary embodiment.
Figure 10B:
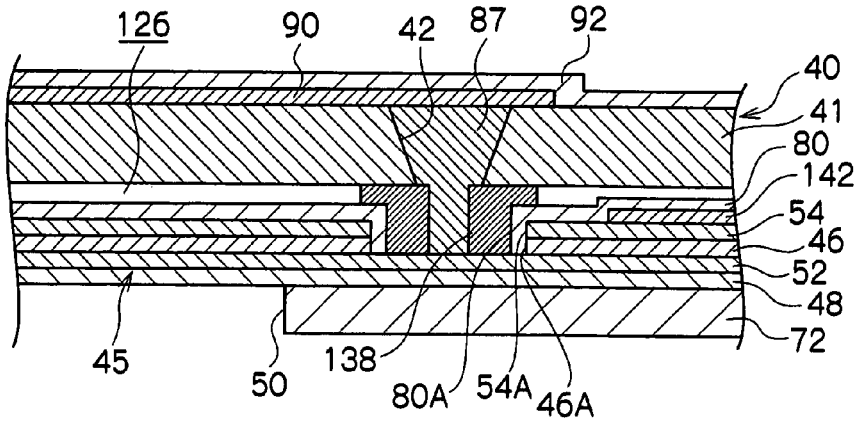
FIG. 10B shows a cross-sectional view of FIG. 10A.

10A shows a schematic plan view of the inkjet recording head 32 and FIG. 10B shows a cross-sectional view of FIG. 10A.

As shown in FIGS. 10A and 10B, in the present exemplary embodiment, a metal film 142 (the hatched regions shown in FIGS. 10A and 10B) of a material such as aluminum is laminated on the upper surface of the upper electrode 54 at the regions except for the drive region of the piezoelectric element 45. Due to this, when compared to the case where the metal film 142 is not laminated, the GND wiring 134 becomes lower in resistance. The metal film 142 is formed in regions except for the drive region of the piezoelectric element 45 so the displacement of the piezoelectric element 45 is not restrained. Here, the metal film 142 is laminated after formation of the piezoelectric element 45 so it is preferable to use a low-resistance aluminum film which can be formed at low temperature.

Here, in this inkjet recording head 32, the vibrating plate 48 (piezoelectric element 45) is arranged between the ink pool chamber 38 and the pressure chamber 50, and the configuration is such that the ink pool chamber 38 and the pressure chamber 50 do not exist on the same horizontal surface. Accordingly, the pressure chambers 50 are arranged adjacent to each other and the nozzles 56 are configured to have a high density.

Further, the drive IC 60 that applies voltage to the piezoelectric element 45 is configured so as not to protrude out to the exterior side more than the piezoelectric element substrate 70 (i.e., it is built in the interior of the inkjet recording head 32). Accordingly, compared to the case where the drive IC 60 is mounted at the outer portion of the inkjet recording head 32, the length of the metal wiring 90 that connects the piezoelectric element 45 and the drive IC 60 can be shorter, thus decreasing the wiring resistance from the drive IC 60 to the piezoelectric element 45.

For the droplet discharging head according to the present invention, the inkjet recording heads 32 are described that discharge ink droplets of each color of yellow (Y), magenta (M), cyan (C), and black (K), and for the droplet discharging apparatus, the inkjet recording apparatus 10 provided with the inkjet recording heads 32 is described. However, the droplet discharging head and the droplet discharging apparatus relating to the present invention are not limited to the recording of images (including characters) on a recording paper P.

Also, in the inkjet recording apparatus 10 of the above-described exemplary embodiments, ink droplets are selectively discharged from inkjet recording portions 30 of each color of black, yellow, magenta, and cyan based on image data and full-color images are recorded on the recording paper P. Nonetheless, the inkjet recording in the present invention is not limited to recording characters and images on a recording paper P.

In other words, the recording medium is not limited to paper and also, the liquid discharged is not limited to ink. The inkjet recording head 32 can be generally applied to all droplet spraying apparatuses used in industry. For example, the present invention can be used to discharge ink on polymer films or glass in order to produce color filters for displays, or to discharge solder in a state of welding onto a substrate to form bumps for component mounting.

Further, in the inkjet recording apparatus 10 of the above-described exemplary embodiments, explanations are given with examples of what is known as full-width array (FWA) that corresponds to the width of the paper. Nonetheless, this can be a partial-width array (PWA) that has a main scanning mechanism and a sub scanning mechanism.

A first aspect of the present invention is a droplet discharging head comprising: a flex-deformable piezoelectric body; a piezoelectric element that has a first electrode and a second electrode that sandwich the piezoelectric body; a vibrating plate arranged at the first electrode side of the piezoelectric element; a wiring plate that is arranged at the second electrode side of the piezoelectric element and is provided with a first electric wiring that supplies an electrical signal to the piezoelectric element; a pressure chamber provided at the side opposite the piezoelectric element with the vibrating plate placed in between; and a discharge port that discharges droplets from the pressure chamber. The first electrode and the first electrical wiring are individually connected via a through-hole formed in the second electrode.

Due to the first aspect, the configuration is such that the first electrode is individually connected to the integrated circuit. When compared to the case where the first electrode formed at the vibrating plate side of the piezoelectric element is individually connected to the integrated circuit that drives the piezoelectric element, a region can be ensured across which the first electrical wiring can be extended to connect the first electrode with the integrated circuit.

The second aspect is the droplet discharging head of the first aspect, wherein the through-hole passes through the piezoelectric body.

Due to the second aspect, even when the piezoelectric elements are arranged in a high density, a region can be ensured for extending across the first electrical wiring.

The third aspect is the droplet discharging head of the first aspect, wherein the through-hole is formed to avoid the piezoelectric body.

Due to the third aspect, the piezoelectric element can be formed at the inner side of the peripheral wall of the pressure chamber and the deformation efficiency of the piezoelectric element can be improved.

The fourth aspect is any one of the droplet discharging heads of the first through third aspects, wherein the wiring plate has an integrated circuit that drives the piezoelectric element, and a second electrical wiring connected to the second electrode is arranged between a connecting portion of the integrated circuit and the first electrical wiring, and an outer edge portion of the wiring plate of the side close to the connecting portion.

Due to the fourth aspect, a region for forming the second electrical wiring which is connected to the second electrode can be ensured, even when the integrated circuit that drives the piezoelectric elements is arranged at the wiring plate.

The fifth aspect is any one of the droplet discharging heads of the first through third aspects, wherein the wiring plate has a connecting component that electrically connects an integrated circuit that drives the piezoelectric element and the first electrical wiring, and a second electrical wiring connected to the second electrode arranged between a connecting portion of the connecting member and the first electrical wiring, and an outer edge portion of the wiring plate of a side close to the connecting portion.

Due to the fifth aspect, a region where the second electrical wiring is formed can be ensured, even when the connecting component that electrically connects the integrated circuit and the first electrical wiring is arranged at the wiring plate.

The sixth aspect is any one of the droplet discharging heads of the first through fifth aspects, wherein each second electrode is electrically linked with each other and functions as common wiring.

Due to the sixth aspect, a ground wiring region can be ensured even when the piezoelectric elements are arranged in a high density.

The seventh aspect is any one of the droplet discharging heads of the first through sixth aspects, wherein a metal film is formed at the second electrode at regions except for the drive region of the piezoelectric element.

Due to the seventh aspect, when compared to the case where the present invention is not used, lower resistance of the second electrical wiring can be achieved.

The eighth aspect is any one of the droplet discharging heads of the first through seventh aspects, further including a liquid storage chamber provided at the side opposite that of the piezoelectric element with the wiring plate placed in between; and an ink supply port that is formed at the wiring plate and which supplies liquid from the liquid storage chamber to the pressure chamber.

Due to the eighth aspect, when compared to the case where the present invention is not used, it is possible to make the droplet discharging head more compact.

The ninth aspect is an inkjet recording device where the droplets are ink, comprising: a conveying portion that conveys a recording medium; a droplet discharging head of any one of the first through eighth aspects that discharges ink onto the recording medium conveyed by the conveying portion; and a control portion that controls an integrated circuit. The control portion controls so that the voltage of the first electrode is greater than the voltage of the second electrode.

Due to the ninth embodiment, when compared to the case where the present invention is not used, it is possible to make the inkjet recording apparatus more compact.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet discharging head comprising:

a piezoelectric element that has a flex-deformable piezoelectric body, a first electrode, and a second electrode that sandwich the piezoelectric body therebetween;

a vibrating plate arranged at the first electrode side of the piezoelectric element;

a wiring plate that is arranged at the second electrode side of the piezoelectric element and is provided with a first electrical wiring that supplies an electrical signal to the piezoelectric element;

a pressure chamber provided at a side opposite the piezoelectric element with the vibrating plate disposed therebetween; and a discharge port that discharges droplets from the pressure chamber, the first electrode and the first electrical wiring being individually connected via a through-hole formed in the second electrode.

2. The droplet discharging head of claim 1, wherein the through-hole passes through the piezoelectric body.

3. The droplet discharging head of claim 1, wherein the through-hole is formed to avoid the piezoelectric body.

4. The droplet discharging head of claim 1, wherein the wiring plate comprises an integrated circuit that drives the piezoelectric element, and a second electrical wiring connected to the second electrode and arranged between a connecting portion of the integrated circuit and the first electrical wiring, and an outer edge portion of the wiring plate at a side close to the connecting portion.

5. The droplet discharging head of claim 1, wherein the wiring plate has a connecting member that electrically connects the integrated circuit that drives the piezoelectric element and the first electrical wiring, and a second electrical wiring connected to the second electrode and arranged between a connecting portion of the connecting component and the first electrical wiring and an outer edge portion of the wiring plate at the side close to the connecting portion.

6. The droplet discharging head of claim 1, wherein each of the second electrodes is electrically connected to each other and functions as common wiring.

7. The droplet discharging head of claim 1, wherein a metal film is formed on the second electrode at regions other than a drive region of the piezoelectric element.

8. The droplet discharging head of claim 1, further comprising a liquid storage chamber provided at the side opposite the piezoelectric element with the wiring plate placed therebetween; and an ink supply port that is formed in the wiring plate and which supplies liquid from the liquid storage chamber to the pressure chamber.

9. An inkjet recording apparatus comprising:

a conveying portion that conveys a recording medium;

a droplet discharging head that discharges ink onto the recording medium conveyed by the conveying portion; and a control portion that controls an integrated circuit, the droplets are ink and the droplet discharging head includes:

a piezoelectric element that has a flex-deformable piezoelectric body, a first electrode and a second electrode that sandwich the piezoelectric body therebetween;

a vibrating plate arranged at the first electrode side of the piezoelectric element;

a wiring plate arranged at the second electrode side of the piezoelectric element and provided with a first electrical wiring that supplies an electrical signal to the piezoelectric element;

a pressure chamber provided at a side opposite the piezoelectric element with the vibrating plate disposed therebetween; and a discharge port that discharges droplets from the pressure chamber, the first electrode and the first electrical wiring being individually connected via a through-hole formed in the second electrode, and the control portion controlling so that the voltage of the first electrode is greater than the voltage of the second electrode.

10. The inkjet recording apparatus of claim 9, wherein the through-hole passes through the piezoelectric body.

11. The inkjet recording apparatus of claim 9, wherein the through-hole is formed to avoid the piezoelectric body.

12. The inkjet recording apparatus of claim 9, wherein the wiring plate comprises the integrated circuit that drives the piezoelectric element, and a second electrical wiring connected to the second electrode is arranged between a connecting portion of the integrated circuit and the first electrical wiring, and an outer edge portion of the wiring plate at a side close to the connecting portion.

13. The inkjet recording apparatus of claim 9, wherein the wiring plate has a connecting member that electrically connects the integrated circuit that drives the piezoelectric element and the first electrical wiring, and a second electrical wiring connected to the second electrode is arranged between a connecting portion of the connecting member and the first electrical wiring, and an outer edge portion of the wiring plate at the side close to the connecting portion.

14. The inkjet recording apparatus of claim 9, wherein each of the second electrodes is electrically connected to each other and functions as common wiring.

15. The inkjet recording apparatus of claim 9, wherein a metal film is formed on the second electrode at regions other than a drive region of the piezoelectric element.

16. The inkjet recording apparatus of claim 9, wherein the droplet discharging head further includes a liquid storage chamber provided at the side opposite the piezoelectric element with the wiring plate therebetween; and an ink supply port that is formed in the wiring plate and which supplies a liquid from the liquid storage chamber to the pressure chamber.

* * * * *